US007548171B2

(12) United States Patent
Koutsoukos et al.

(10) Patent No.: US 7,548,171 B2
(45) Date of Patent: Jun. 16, 2009

(54) WIRELESS SENSORS FOR SYSTEM MONITORING AND DIAGNOSTICS

(75) Inventors: Xenofon Koutsoukos, Nashville, TN (US); Patrick C. P. Cheung, Castro Valley, CA (US)

(73) Assignee: Xerox Corporation, Norwalk, CT (US)

( * ) Notice: Subject to any disclaimer, the term of this patent is extended or adjusted under 35 U.S.C. 154(b) by 400 days.

(21) Appl. No.: 10/248,134

(22) Filed: Dec. 19, 2002

(65) Prior Publication Data

US 2004/0130458 A1 Jul. 8, 2004

(51) Int. Cl.
*G08C 19/16* (2006.01)

(52) U.S. Cl. ..... 340/870.01; 340/870.26; 358/1.5; 358/1.6; 355/400; 355/407; 399/10; 399/21

(58) Field of Classification Search ..... 340/685, 340/870.01, 870.05, 870.11, 539.1, 531, 340/683, 870.26; 358/400, 1.5, 1.15, 1.6; 702/56; 367/129; 347/19, 101, 104, 248; 271/186, 225, 258.01, 902, 10.1, 10.11, 117, 271/118, 220, 221, 262, 265.02, 265.04; 355/400, 407, 408; 399/10, 21, 31, 35, 37, 399/38.1, 40, 40.1, 46, 53, 87
See application file for complete search history.

(56) References Cited

U.S. PATENT DOCUMENTS 4,956,824 A * 9/1990 Sindeband et al. ..... 367/129
4,968,978 A * 11/1990 Stolarczyk ..... 340/854.6
5,053,815 A * 10/1991 Wendell ..... 399/10
5,087,099 A * 2/1992 Stolarczyk ..... 299/1.6
5,854,994 A * 12/1998 Canada et al. ..... 702/56
6,104,987 A * 8/2000 Farnsworth ..... 702/130
6,225,901 B1 * 5/2001 Kail, IV ..... 340/539.11
6,259,372 B1 * 7/2001 Taranowski et al. ..... 340/683
6,441,793 B1 * 8/2002 Shea ..... 343/753
6,754,196 B1 * 6/2004 Daane et al. ..... 370/338

* cited by examiner

*Primary Examiner*—Benjamin C Lee
*Assistant Examiner*—Sisay Yacob
(74) *Attorney, Agent, or Firm*—Oliff & Berridge, PLC

(57) ABSTRACT

A plurality of wireless sensors can be placed within a large system in various locations to monitor critical elements of that system. Each wireless sensor can include sensor elements usable to monitor one or more parameters of an element of the system and a wireless signal transmitter, such as, for example, a speaker or an antenna. Each sensor can transmit one or more unique identifying signals to a signal-receiving device, which can be processed by a signal processor. The signal processor can determine each received signal, the sensor corresponding to that identified signal, and the time the wireless signal was generated. Based on this information, the wireless signals can be diagnostically compared against expected values for the system being monitored and evaluated. If a discrepancy is detected, then the components and/or subsystems within the system that are implicated in the discrepant wireless signals can be evaluated for possible errors.

20 Claims, 12 Drawing Sheets

| MODULE | INPUT= RISING EDGE | INPUT= FALLING EDGE |
|---|---|---|
| 1 | A1 | A2 |
| 2 | B1 | B2 |
| 3 | C1 | C2 |
| 4 | D1 | D2 |
| 5 | E1 | E2 |
| 6 | F1 | F2 |
| 7 | G1 | G2 |
| 8 | H1 | H2 |
| 9 | I1 | I2 |
| 10 | J1 | J2 |

FIG. 10

WIRELESS SENSORS FOR SYSTEM MONITORING AND DIAGNOSTICS

BACKGROUND OF THE INVENTION

1. Field of Invention

This invention is directed to systems and methods for monitoring and diagnosing systems using wireless sensors.

2. Description of Related Art

Large, complex electro-mechanical systems, such as modern printers, require precise interaction of components to ensure healthy operation. Using advanced diagnostics helps reduce maintenance costs and extend the life of such systems. Current techniques for monitoring and diagnosing subsystems, such as paper paths of printers or copiers, can be accomplished by using sensors. To diagnose faults and errors resulting from degrading components and subsystems, precise knowledge of the position, the motion and/or the condition of the components and subsystems at a given moment is needed. This can be accomplished by a monitoring system that uses sensors.

In a printer, the paper path is a critical system that requires monitoring. By measuring the motion of paper sheets along the path using fault-tolerant measurement techniques, it is possible to diagnostically evaluate critical components. There are two ways to implement such measuring techniques into large systems, such as a printer system. One is to design the measurement capability into the system at the factory. The second way is to retrofit existing systems by service personnel. In this second way, a technician can either fit the measurement apparatus onto a printer and leave it there permanently, or can install the apparatus onto the system only for that particular repair session.

Many known techniques for monitoring and diagnosing subsystems, such as paper paths, are based on infrared (IR) sensors. When used to monitor the paper paths of printers, such sensors can detect the edge of paper sheets. One such IR sensor is the optical sensor found in an optical mouse. When used in a printer for monitoring and diagnosis, optical sensors can collect velocity and positional data.

However, these optical sensors are unable to monitor high-speed operations and rely heavily on the aggregate velocity measurements of many optical sensors. Increased computational power of digital electronics, the availability of wireless electronics, and the availability of microelectronic sensing components enable use of low cost collaborative sensor and diagnostic systems.

SUMMARY OF THE INVENTION

The requirements for building faster and/or more robust electro-mechanical require sensing technologies that can provide continuous measurements of critical parameters of those systems.

This invention provides systems and methods for monitoring and diagnosing large systems.

This invention separately provides systems and methods for using wireless sensors to continuously monitor and transmit system information.

This invention separately provides systems and methods for receiving and processing system information.

This information separately provides systems and methods for diagnosing system information.

In various exemplary embodiments of the systems and methods according to this invention, a multitude of self-powered wireless sensors can be placed within a large system in various locations to monitor critical elements of the system.

In various exemplary embodiments of the systems and methods according to this invention, each wireless sensor can include sensor elements usable to monitor one or more parameters of an element of the system, digital and analog circuits, an amplifier, and/or a signal transmitter, such as, for example, a speaker or an antenna.

In various exemplary embodiments of the systems and methods according to this invention, each sensor can transmit a unique identifying signal to a signal-receiving device. The one or more unique identifying signals received by the signal-receiving device can be processed by a signal processor. The processor can determine the unique identifying signal and the sensor corresponding to that identified signal, as well as determine the time the wireless signal was generated. Based on the originating sensor type and timing of the wireless signals, the wireless signals can be used to diagnose faults in the system.

In various other exemplary embodiments of the systems and methods according to this invention, the originating sensor type and/or timing data of the wireless sensor signals can be diagnostically compared against expected values for the particular system being monitored and evaluated. If a discrepancy is detected, then the components and/or subsystems within the system that are implicated in the discrepant wireless signals can be evaluated for possible errors.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail, with reference to the following figures, wherein:

FIG. 10 illustrates one exemplary embodiment of a frequency looktable for sensors according to this invention;

DETAILED DESCRIPTION OF EXEMPLARY EMBODIMENTS

Figure 1:
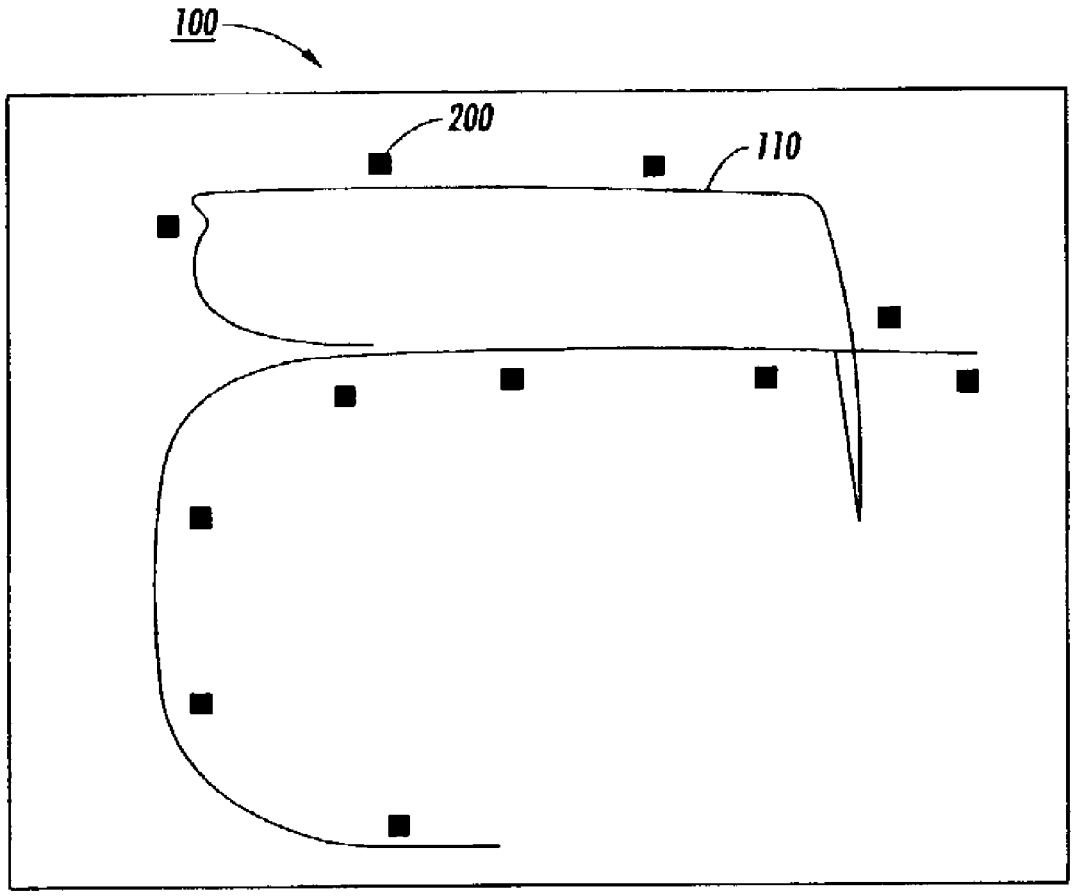
FIG. 1 illustrates one exemplary embodiment of wireless sensors in a paper path of a printer system according to the systems and methods of this invention.

The systems and methods of this invention enable diagnostic analysis of large electro-mechanical systems and/or devices by using wireless sensors to monitor critical elements. Each self-powered sensor can monitor one or more parameters and transmit a unique identifying signal to a signal processor. The signal processor uses the unique identifying signal to diagnostically determine system faults and errors. It should be appreciated that, for ease of explanation only, the following exemplary embodiments are directed to one particular such system or device, a paper transport subsystem of a printer system. It should be further appreciated that the principles of this invention, as outlined and/or discussed below, can be equally applied to any known or later-developed large system monitoring and diagnostic methods, beyond the printer system specifically discussed herein.

For example, the inability of current sensing techniques to measure position and velocity of paper sheets along paper paths in high-speed printers limits the performance of system diagnostics for such systems. In various exemplary embodiments of the systems and methods of this invention, the position and velocity of paper sheets moving in a paper path of a printer are measured by using a multitude of wireless sensors. In various exemplary embodiments, the systems and methods according to this invention will detect motion of paper along the paper path by sensing one or more specially marked paper sheets. It should be appreciated that the type of sensors used along the paper path may be predicated on the type of printer system being monitored. It should further be appreciated that the number of sensors used along a paper path may vary depending on the printer being diagnosed.

It should also be appreciated that, in various exemplary embodiments of the systems and methods according to this invention, multiple ones of the wireless sensors can be activated at any time. Thus, each of the sensors generally outputs its sensor signals at such that at least one of the characteristics of the sensor signal from one sensor can be distinguished from that of the other sensors. In this way, different sensors can be activated at the same time while still being able to identify which sensors were active and, possibly, some values indicated by the sensor signals of those sensors. For example, in the example referenced above, in various exemplary embodiments, multiple sheets may be traveling along the paper path at the same time, such that different ones of the various wireless sensors positioned along the paper path may be actively generating their sensor signals at the same time, in such a way that each sensor can be distinguished from all of the other sensors.

It should further be appreciated that, in various exemplary embodiments of the systems and methods according to this invention, the sensors wirelessly transmit their sensor signals in a burst mode. In contrast, in various other exemplary embodiments, the sensors wirelessly transmit their signals in other than a burst mode. In a burst mode, the sensor signal outputs a signal for only a relatively short period of time. For example, when the sensors generate audio or electro-magnetic signals, the frequency of the signals can be used to distinguish the signal from one sensor from that of another sensor. When using the burst mode, at most only a few cycles of the audio or electro-magnetic signal are generated, for example, 3-10 cycles.

Transmitting the sensor signals using a burst mode is advantageous for a number of reasons. First, because the signals are short, it is less likely that a large number, or even two, signals will over lap. Second, even when signals overlap, only a few cycles are needed to distinguish a signal at one frequency from one or more other signals at different frequencies. Third, the signals are less likely to cause environmental problems. For example, for audio signals, if the signals are at frequencies within the range of human hearing, which is very likely, short signals that have minimal overlap with other signals are more tolerable to the human operator of the system in which the sensors are mounted. Likewise, for electro-magnetic signals, using a burst mode is less likely to generate significant interference in other nearby electro-magnetic devices.

In various exemplary embodiments, the sensors transmit a predefined, unique signal. The techniques the sensors use to transmit this predefined unique signal may vary. It should be appreciated that the type of signal transmitted by the wireless sensor may be dependent upon the type of printer used and/or the signal receiver used. For example, in various exemplary embodiments, each sensor emits an audible chirp at a sensor-specific frequency when measuring prepaper sheets as the sheets move along the paper path. In various other exemplary embodiments, each sensor transmits a signal using a sensor-specific radio frequency.

In various exemplary embodiments, a signal processor receives and determines the motion data of all the sheets transported along the paper path. By comparing the velocity and position of sheets within the paper path to a predetermined model for the printer system, faults and errors within the printer system may be determined. It should be appreciated that the signals can be transmitted by the sensors in real time and received by the signal processor in real time. Alternatively, the signals can be transmitted may be recorded and stored and the stored signals diagnostically analyzed at a later time.

FIG. 1 illustrates one exemplary embodiment of a printer system 100 implementing one exemplary embodiment of the systems and methods according to this invention that allows the paper path to be continuously monitored. As shown in FIG. 1, the printer system 100 includes a printer path 10 and a number of sensors 200. The sensors 200 are spaced along the paper path 110 in predetermined locations.

In various exemplary embodiments, the number of sensors 200 are portable, reusable wireless devices capable of sensing a parameter of the paper path 110, such as the motion of paper sheets moving along the paper path 110 during printing. In various exemplary embodiments, the number of sensors 200 may comprise any suitable set of devices or arrangement of devices, either known or later developed.

In various exemplary embodiments, the paper path 110 includes the components of the printer system 100 that define the path the paper sheets follow between a paper tray that stores the paper sheets and the an output tray of the printer system 100. The paper path 110 may include a series of rollers, solenoids, and/or gates and the like that controllably move the paper sheets along a predetermined path.

The number of sensors 200 shown in FIG. 1 are positioned along the paper path 110 such that a paper sheet is continuously monitored by one or more of the number of sensors 200 as the paper sheet moves along the paper path 110 between the paper tray and the output tray. It should be appreciated that more than one paper sheet can be continuously monitored by the number of sensors 200 as the paper sheets moves along the paper path 110 between the paper tray and the output tray. The distances between any set of the number of the sensors 200 do not need to be predetermined. In various exemplary embodiments, the distances between any set of the number of sensors 200 should be less than the width and/or length of a paper sheet. The sensors 200 can be mounted using adhesives, any known or later-developed mechanical fasteners, magnetic fasteners, or any combination of these attaching techniques.

It should be appreciated that the types of the various ones of the number of sensors 200 and the number and type of the associated signal processor(s) used to monitor and evaluate the printer system 100 may vary or differ depending on the type of sensors 200 and/or signal processor(s) being used. The systems and methods of this invention do not depend on any specific sensor(s) and/or signal processor(s). Accordingly, the systems and methods are usable with any appropriate sensor(s) and/or signal processor(s). In particular, any signal processing techniques, methods, devices and the like can be used with the wireless sensors and methods according to this invention so long as the implemented signals processing technique, method, device and/or the like is able to adequately distinguish from one another the sensor signals generated by two or more of the wireless sensors.

Figure 2:
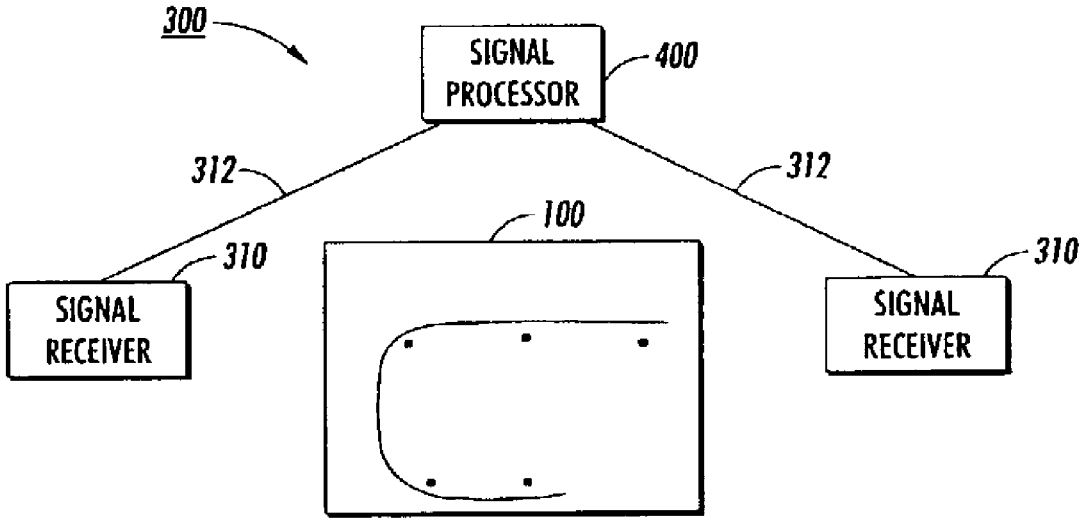
FIG. 2 is a block diagram of one exemplary embodiment of a signal processing system usable with the printer system and paper path of FIG. 1 according to the systems and methods of this invention.

FIG. 2 shows one exemplary embodiment of a data acquisition system 300 used to gather and process signal data from the sensors 200. As shown in FIG. 2, the data acquisition system 300 includes one or more signal receivers 310 and a signal processor 400. As shown in FIG. 2, the one or more signal receivers 310 are used to collect the signals generated by the number of sensors 200. The one or more signal receivers 310 are connected to the signal processor 400 by a connection 312. The connection 312 may be any known or later-developed device or system for connecting and integrating systems and/or devices, such as a direct cable connection, a connection over a wide area network, a local area network, or a storage area network, a connection over an intranet or an extranet, a connection over the Internet, or a connection over any other distributed processing network or system. It should be appreciated that the connection 312 can include one or more wireless portions and/or one or more wired portions.

It should be appreciated that the signal receivers 310, the signal processor system 400, and the printer system 100, while depicted separately, are not necessarily separate and distinct components. Thus, the functions and/or operations of each of these elements may be carried out by one or more devices, structures, and/or systems that combine two or more of these functions and/or operations into a single element.

As shown in FIG. 2, the one or more signal receivers 310 may be any devices that are capable of receiving signals from the number of sensors 200, such as audible signals and/or radio frequency signals. For example, the one or more signal receivers 310 may be microphones capable of detecting audible signals from the number of sensors 200. In this case, the one or more signal receivers 310 may be implemented using a microphone, such as a microphone that is present into a laptop computer, personal digital assistant, cell phone or other mobile computing device that is carried to the device containing the wireless sensors 200 by a technician or the like.

Alternatively, the one or more signal receiver 310 may be radio-frequency receivers capable of receiving radio frequency electro-magnetic signals. In general, any known or later-developed hardware and/or software system capable of receiving data and information from the number of sensors 200 used in a particular application may be used to implement one or more of the one or more signal receivers 310. In various exemplary embodiments, the one or more signal receivers 310 may be implemented using a radio-frequency receiver that is present into a laptop computer, personal digital assistant, cell phone or other mobile computing device that is carried to the device containing the wireless sensors 200 by a technician or the like.

In various exemplary embodiments, the received sensor signals are analyzed by a signal processing circuit, routine, or application, as outlined below, incorporated into and/or executing on the mobile computing device or another device wirelessly-connected or wiredly-connected to the mobile computing device. In various exemplary embodiments where audio signals are generated, the received sensor signals can be stored into a sound file, such as a WAV file, for later analysis. Similarly, in various exemplary embodiments where electromagnetic signals are generated, the received sensor signals can be stored into a file for later analysis.

Figure 3:
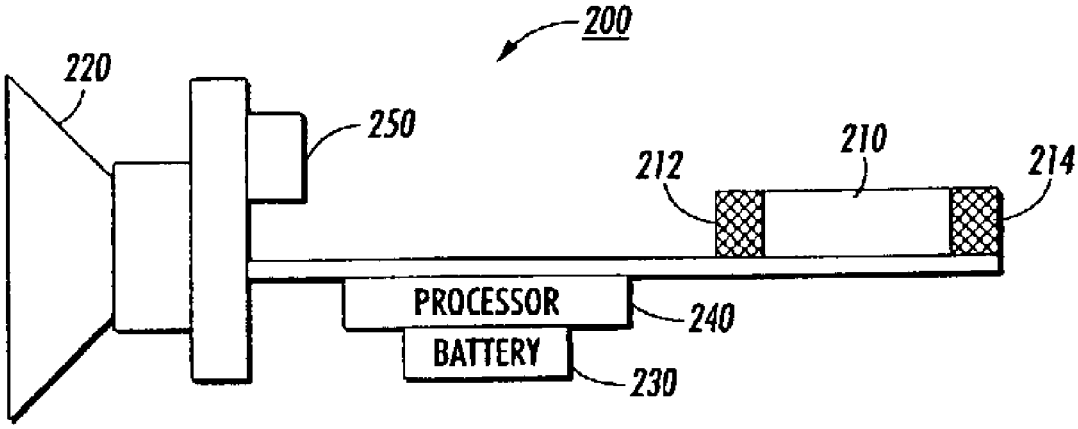
FIGS. 3 and 4 are side and top views of one exemplary embodiment of a sensor usable with the systems and methods of this invention.
Figure 4:
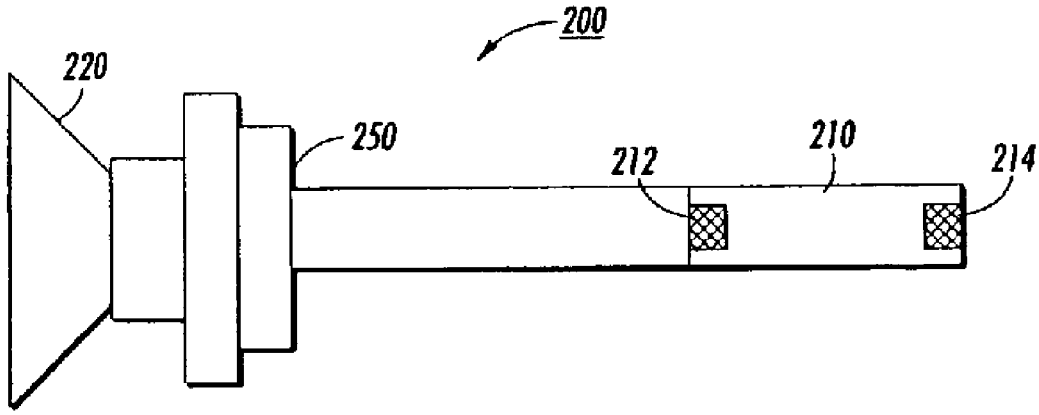

FIGS. 3 and 4 are side and top views, respectively, of one exemplary embodiment of a sensor 200. In particular, the sensor 200 shown in FIGS. 3 and 4 is particularly useful when placed along the paper path 110. In this case, the sensor 200 is usable, according to this invention, to detect preand/or coated paper sheets as those paper sheets travel along the paper path 110 and usable to transmit a signal. As shown in FIGS. 3 and 4, in various exemplary embodiments, the sensor 200 includes a reflective sensor element 210, a signal transmitter 220, a battery 230, and a sensor processor 240. In various exemplary embodiments, the sensor 200 is mounted to a surface of the printer system 100 via a connector 250. The sensor 200 may be mounted in a manner that allows the sensor 200 to accurately and unimpededly read the paper sheets as the paper sheets travel along the paper path 110. The connector 250 can be any available appropriate mounting device, structure or material, including, for example, adhesive, mechanical fasteners, and/or magnetic fasteners and the like.

In various exemplary embodiments, the reflective sensor element 210, as shown in FIGS. 3 and 4, includes a light emitter 212 and a light detector 214. The light emitter 212 can be any type of device that emits a light signal, such as, for example, an LED. The light emitter 212 can be any device that emits electromagnetic radiation in any portion of the spectrum that is compatible with the type of measurement required. For example, to reduce the effects of ambient light noise in a printer, the infrared portion of the electromagnetic spectrum may be used by the light emitter 212. The light detector 214 measures the amount of electromagnetic energy output by the light emitter 212 that is reflected off a surface. The light detector 214 can convert the received electromagnetic energy into a modulation of one or more parameters of an output signal, such as a voltage amplitude, a D.C. value, a frequency, and/or a phase, or the like.

As seen in FIGS. 3 and 4, the battery 230 represents any device that provides power to the sensor 200. The signal transmitter 220 can be any device usable to transmit the output signal to the one or more signal receiver 310. The signal transmitter 220 may be implemented using an audio speaker, as a radio-frequency transmitter, as an infrared frequency transmitter, or using any other appropriate know or later-developed signal transmitter.

The sensor processor 240 shown in FIGS. 3 and 4 can be implemented as a physically distinct hardware circuit, a discrete logic element, a discrete circuit element or a software application, manager, routine or the like. The particular form of the circuit, routine or manager used to implement the sensor 200 will be obvious and predictable to those skilled in the art.

In operation, the output signal output from the light detector 214 to the sensor processor 240 based on the amount of electromagnetic energy reflected from the light emitter 212 by the paper sheet is processed by the sensor processor 240.

The sensor processor 240 can then generate a sensor signal based upon the output signal and output the sensor signal to the signal transmitter 220.

Figure 5:
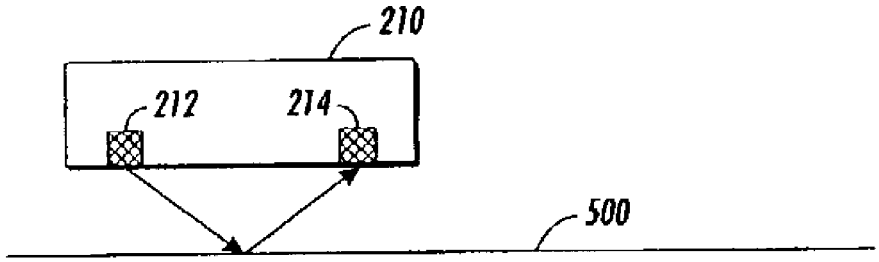
FIG. 5 illustrates an exemplary embodiment of a sensor module with a light emitter and light detector according to this invention.

FIG. 5 shows how the reflective sensor 210 detects the presence and/or absence of, and motion of, a test sheet 500. In operation, as the test sheets 500 travel past the sensor module 200, the light emitter 212 emits electromagnetic energy toward where the test sheets 500 are expected to be. The light detector 214 detects the amount of electromagnetic energy, if any, reflected back to the sensor 200. It should be appreciated that the level of light reflected off the test sheets 500, as depicted by the arrows, may vary depending on the presence or absence of dark or light bands as depicted in greater detail with respect to FIG. 6. It should be further appreciated that, when the test sheets 500 are not present under the reflective sensor 210, the light detector 214 will receive a predetermined amount, such as no, reflected electromagnetic energy from the light emitter 212 and therefore will generate an input signal that is defined as a null value.

Figure 6:
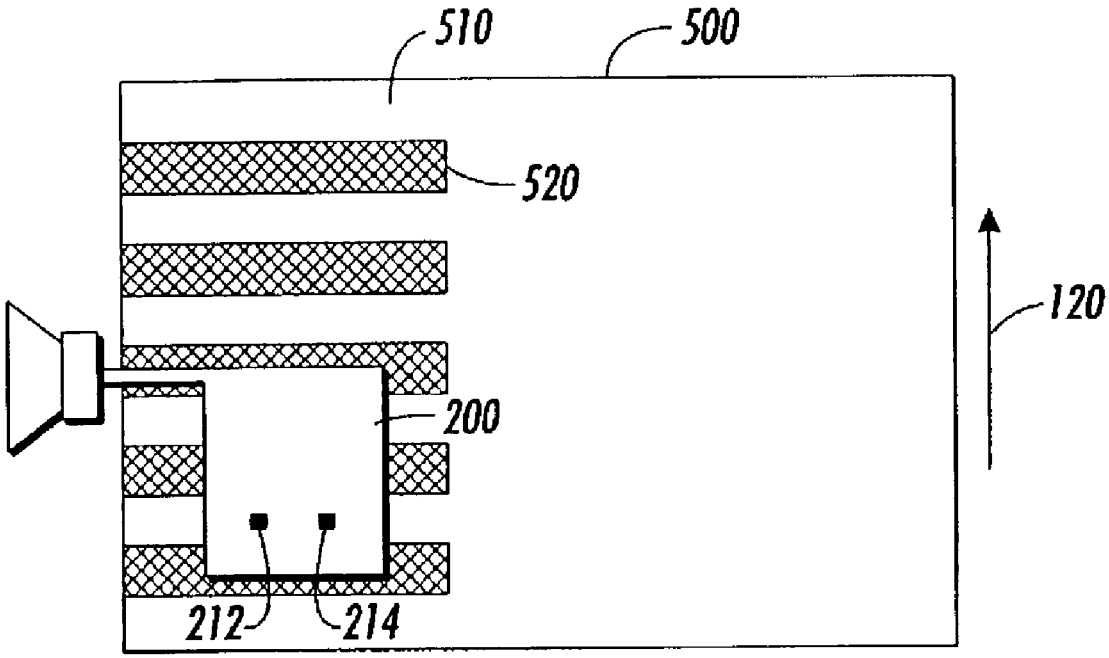
FIG. 6 illustrates an exemplary embodiment of a paper sheet with preprinted bands according to this invention.

In various exemplary embodiments, in operation, the sensors 200 placed along the paper path 110 detect one or more sheets of the test paper 500 preprinted with relatively higher reflectively and relatively lower reflectivity bands, as depicted in FIG. 6. FIG. 6 shows an exemplary embodiment of a preprinted test sheet 500 with alternating white bands 510 and dark bands 520. As shown in FIG. 6, a sensor 200 is situated over the preprinted test paper 500 so that the sensor 200 is able to sense the bands 510 and 520 as the test sheet 500 moves along a paper direction 120 of the paper path 110.

Figure 7:
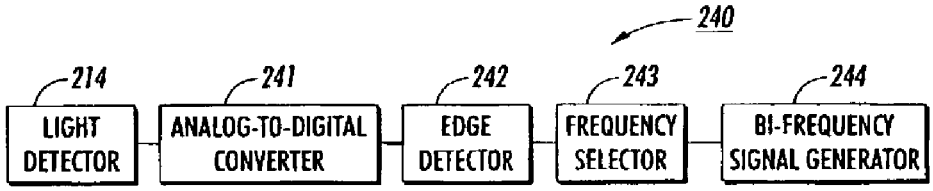
FIG. 7 is a block diagram of one exemplary embodiment of a sensor system according to this invention.

FIG. 7 illustrates one exemplary embodiment of the sensor processor 240 that is usable with the reflective sensor 210 and the test sheet 500. As shown in FIG. 7, the sensor processor 240 includes an analog-to-digital converter 241, an edge detector 242, a frequency selector 243, and a bisignal generator 244. It should be appreciated that the signal processing functions of the sensor processor 240, as depicted in FIG. 7, may vary and can be implemented dependent upon the features being sensed by the sensor 200, the requirements of the sensor 200 and/or the one or more signal receivers 310 being used.

It should be appreciated that each sensor module 200 outputs a unique sensor signal. The unique output sensor signal is modulated by the varying levels of electromagnetic energy reflected off the test sheets 500. Electromagnetic energy received by the light detector 214 generates a modulated output signal that is provided to the sensor processor 240. The modulation of the output signal from the light detector 214 is a function of the amount of electromagnetic energy reflected by the preprinted bands on the test sheet 500.

In operation, the light detector 214 provides the modulated output signal to the analog-to-digital converter 241. As discussed above, the level of modulation can vary based upon the presence or absence of pre-printed bands. For example, white bands reflect more electromagnetic energy than black bands, resulting in a higher modulated signal from the light detector 214. The analog-to-digital converter 214 converts the analog electromagnetic energy signal into a digital waveform. The waveform rising edge, for the white band 510, and the waveform falling edge, for the black band 520, is detected by the edge detector 242.

Based upon whether a rising edge or falling edge is detected by the edge detector 242, the frequency selector 243 selects a frequency at which to transmit the signal. In various exemplary embodiments, the frequency for each sensor 200 is unique. Further, a distinct frequency can be selected by each sensor 200 when detecting a waveform rising edge and when detecting a waveform falling edge. The selected frequency is then generated by the bi-frequency signal generator 244 and transmitted by the signal transmitter 220. It should be appreciated that the sensor processor 240 may vary and the particular design, capability, and/or function that the sensor processor 240 takes will be obvious to those skilled in the art.

Figure 8:
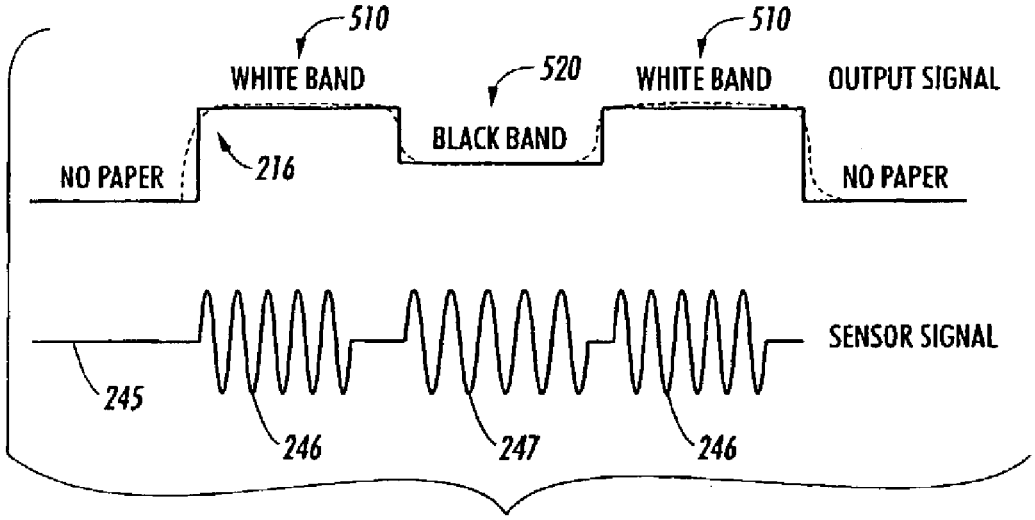
FIG. 8 illustrates an exemplary embodiment of the output signal from a sensor module according to this invention.

FIG. 8 illustrates one exemplary embodiment of an output signal 216, a digital waveform 218, a sensor signal 245, and the corresponding portions of the test sheet 500. As shown in FIG. 8, the light detector 214 outputs the output signal 216 in response to the presence of the test sheet 500 and then the presence of the bands 510 and 520. In particular, the output signal 216 has no modulation when the test paper 500 is not present. The presence of the test paper 500 and the subsequent reflection of electromagnetic energy off the white band 510 induces an increase in the output signal 216. Conversely, the presence of the black band 520 reduces the electromagnetic energy reflection, causing the output signal 216 to decrease until the next white band 510 passes under the reflective sensor 210. It should be appreciated that the modulation of the output signal 216 may vary, depending on the number of white bands 510 and black bands 520 on the test sheet 500.

As shown in FIG. 8, the digital waveform 218 is depicted overlaid the output signal 216. In various exemplary embodiments, the digital waveform 218 can be generated by the analog-to-digital converter 241 using the analog output signal 216. In various exemplary embodiments, detection of the rising and falling edges of the digital waveform 218 by the sensor processor 240 can initiate the transmission of the sensor signal 245.

As shown in FIG. 8, the sensor signal 245 is composed of a frequency 246 and a frequency selected, for example, from a look-up table of stored frequencies of various wavelengths. The detection of the rising edge of the output signal 216 initiates a sensor signal 245 to be transmitted at a frequency 246 and the falling edge initiates a sensor signal 245 to be transmitted at a frequency 247. The duration of the transmission of the sensor signal at the frequencies 246 and/or 247 can vary depending on the systems monitored and/or systems used to process the sensor signals 245. In various exemplary embodiments, the sensor signals 245 are transmitted in a burst mode where only a few cycles of the sensor signal 254 at the frequency 246 or 247 are generated in response to the rising or falling edges of the output signal 216.

While the above-outlined exemplary embodiment has focused on detecting bands on a specially-prepared sheet of paper as it travels along a paper path, it should be appreciated that the systems and methods according to this invention, as illustrated by this exemplary embodiment, can be used in any number of situations and in any desired location in any desired system as appropriate. Thus, this above-outlined embodiment should be understood to be exemplary only, and not limiting of the scope and breadth of the systems and methods according to this invention.

Figure 9:
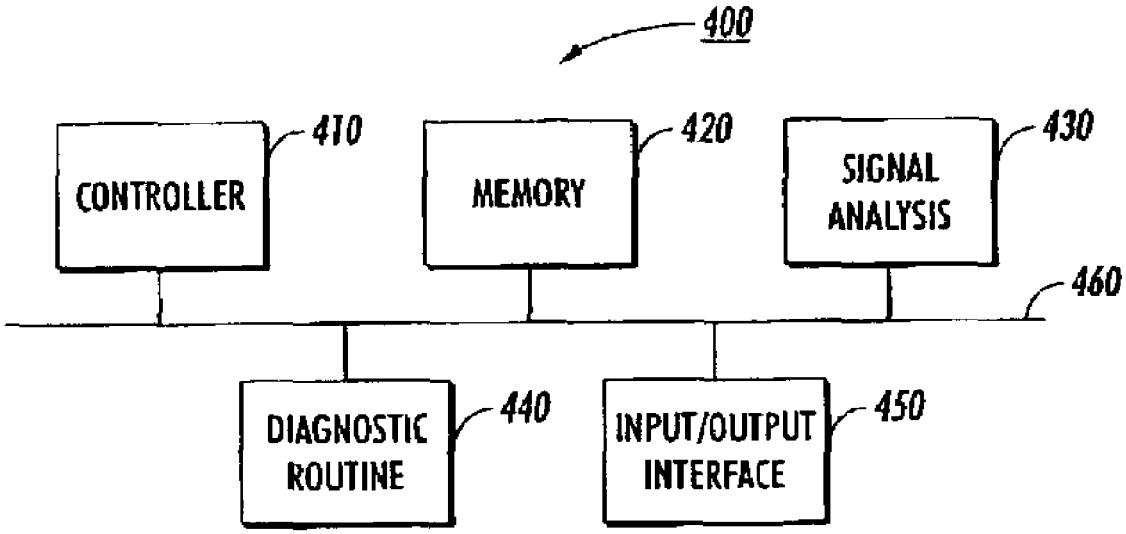
FIG. 9 is a block diagram of one exemplary embodiment of the signal processing system according to this invention.

FIG. 9 is a block diagram of one exemplary embodiment of the signal processor 400 usable to process the sensor signal received by the one or more signal receivers 310. As shown in FIG. 9, the signal processor 400 includes one or more of a controller 410, a memory 420, a signal analysis circuit, routine or application 430, a diagnostic circuit, routine or application 440, and an input/output interface 450, each connected by one or more control and/or data busses and/or application programming interfaces 460.

As shown in FIG. 9, in various exemplary embodiments, the memory 420 can be implemented using any appropriate combination of alterable, volatile, or nonmemory or nonor fixed memory. The alterable memory, whether volatile, or noncan be implemented using any one or more static or dynamic ram, a floppy disk and disk drive, a writeable or rewriteable optical disk and disk drive, a hard drive, flash memory or the like. Similarly, the nonor fixed memory can be implemented using any one or more of ROM, PROM, EPROM, EEPROM, and gaps on optical ROM disk, such as a CD or DVDdisk, and disk drive or the like.

It should be appreciated that the signal processor system 400 shown in FIG. 9 can be implemented as one or more portions of a programmed general-purpose computer used to control and analyze the signals received from the one or more sensors 200. The signal processor system 400 can be implemented using one or more of any of a digital signal processor (DSP), an ASIC, a FPGA, a PLD, a PLA, or a PAL, or using physically distinct hardware circuits, such as discrete logic elements or discrete circuit elements. The particular form the signal processor 400 will take is a design choice and will be obvious to those skilled in the art.

Alternatively, the signal processor device 400 can be implemented as one or more portions of a software program usable to form the overall control of the computing device. In this case, each of the controller 410, the signal analysis circuit, routine or application 430, and/or the diagnostic circuit, routine or application 440 can be implemented as software routines, objects and/or application programming interfaces or the like.

In operation, the signal analysis circuit, routine or application 430 receives the unique signals from the one or more signal receivers 310 via the input output interface 450. In various exemplary embodiments, the unique signals will overlap each other at least partially, so that two or more of the unique signals may occur at the same time in the net signal received by the one or more signal receivers. The signal analysis circuit, routine or application 430 identifies the unique frequencies transmitted by the individual sensors 200 that are contained in the net sensor signal and determines the time each frequency was emitted. By identifying the particular sensors 200 whose sensor signals were received by the one or more signal receivers 310 and timing data for those sensor signals, the system containing the one or more wireless sensors can be analyzed. For example, in the exemplary embodiment outlined above, full motion data of the test sheets 500 passing through the paper path 110 can be ascertained.

The signal analysis circuit, routine or application 430 analyzes the received signal frequencies for content. In various exemplary embodiments, since the signal content of the net sensor signal, i.e., the total set of sensor signals received by the signal receivers 310, changes over time, a typical function is used to analyze the signal frequency components within a moving time window. For example, the windowed fast Fourier (WFF) transform function may be used. In various exemplary embodiments, when a signal frequency is identified as a likely signal candidate from one of the one or more sensors 200, a band-pass filter is set to that frequency to filter out the other signal frequencies.

In various exemplary embodiments, the filtered time window is subjected to a correlation test, where a time-convolution is run against a predetermined signal template. In various exemplary embodiments, the time where the highest correlation occurs when compared against the predetermined signal template indicates the beginning of the unique sensor signal. Since one or more sensor signals can occur at a given time, band-pass filtering and correlation may be done based on a plurality of signal templates. The most accurate identification is then determined.

The diagnostic circuit, routine or application 440 takes the identified signals from the signal analysis circuit, routine or application 430 and analyzes the system containing the one or more wireless sensors. For example, in the exemplary embodiment outlined above, the diagnostic circuit, routine or application 440 reconstructs the instantaneous velocity and positional data of all the test sheets 500 in the paper path 110. In this exemplary embodiment, the positional and sensing data derived from the signal analysis circuit, routine or application 430 are compared against expected values derived from detailed dynamical models of the printer system 100. If a discrepancy is detected, then the components driving the test sheets 500 along the paper path 110 at the current time instance identified become fault candidates. It should be appreciated that future and past measurements can be considered to isolate possible component faults.

FIG. 10 illustrates one exemplary embodiment of a look-table that stores various frequency wavelengths for a number of sensors 200. Each entry in the look-up table in FIG. 10 contains two distinctive frequency signal component values for each sensor 200. The first frequency component corresponds to the rising edge of the waveform input from the light detector 214. The second signal frequency component corresponds to the falling edge of the waveform received from the light detector 214. It should be appreciated that there is no specific limit to the number of sensors 200 that can be used as long as the look-up table allows the signal processor system 400 to distinguish among all the frequencies used.

Figure 11:
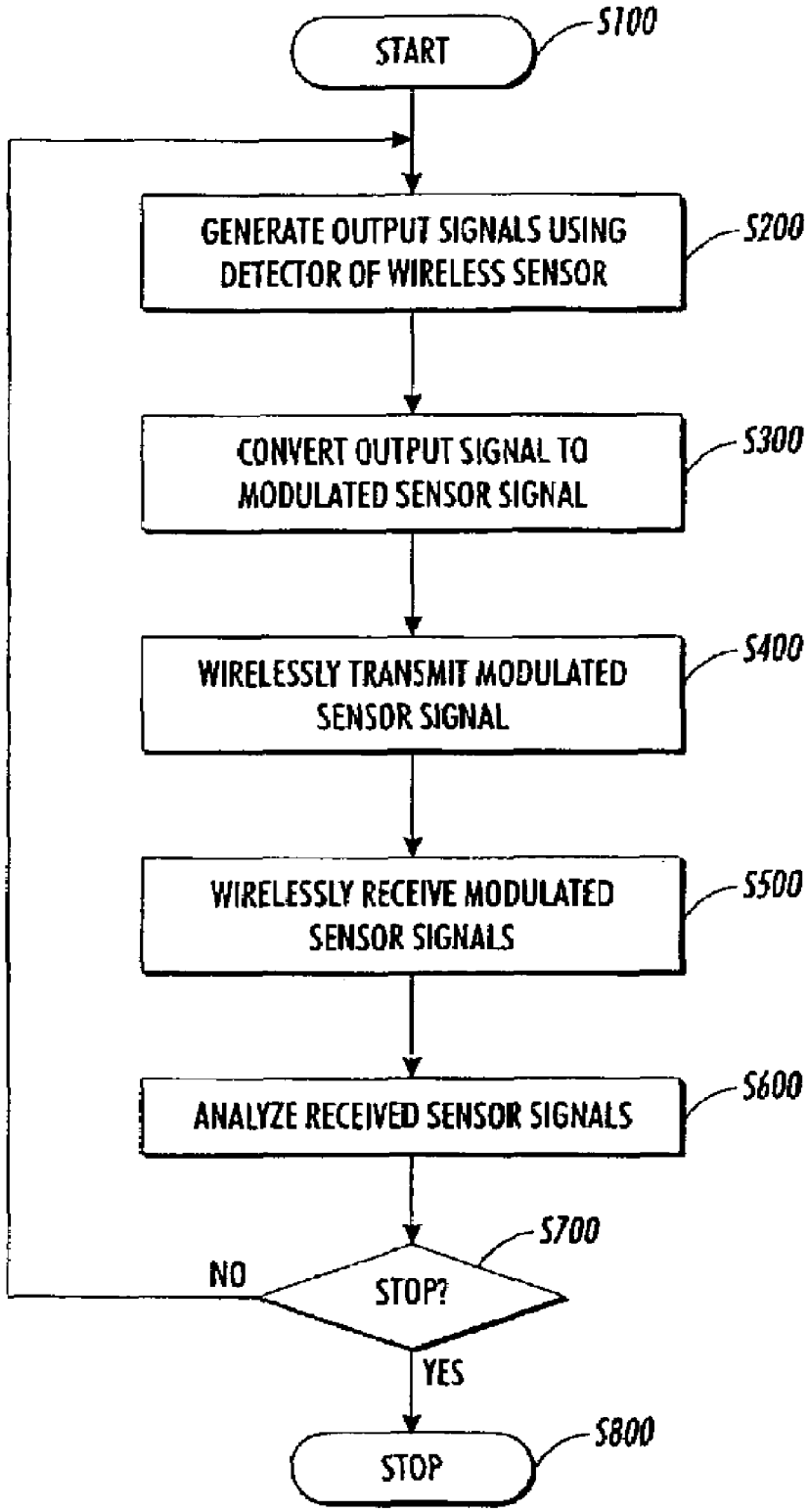
FIG. 11 is a flowchart outlining one exemplary embodiment of a method for operating of a sensor module according to this invention.

FIG. 11 is a flowchart outlining one exemplary embodiment of the method for operating wireless sensors according to this invention. Beginning in step S100, operation continues to step S200, where output signals are generated using a sensor element of one of the wireless sensors. Then, in step S300, the output signal is converted to a modulated sensor signal. Next, in step S400, the modulated sensor signals is wirelessly transmitted, for example by generating an audio signal or by broadcasting an electromagnetic signal. Operation then continues to step S500.

In step S500, the transmitted modulated sensor signal is received by a signal processor that is capable of receiving the transmitted sensor signal. For example, the signal processor can be capable of receiving an audio signal or a broadcast electromagnetic signal. Next, in step S600, the received sensor signal is analyzed. Then, in step S700, a determination is made whether to stop the process. If the process is to be stopped, operation continues to step S800 where the operation of the method ends. Otherwise, operation jumps back to step S200.

Figure 12:
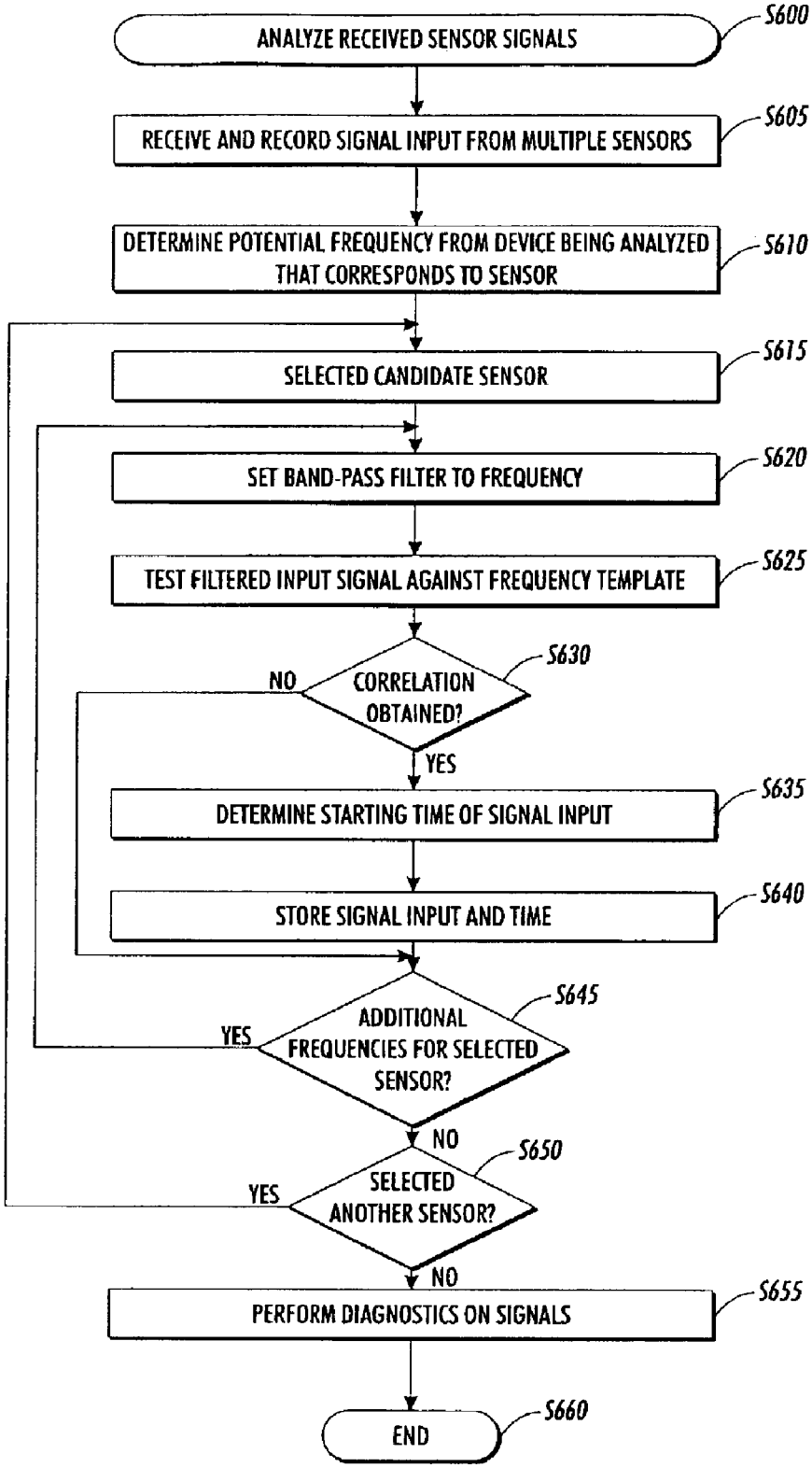
FIG. 12 is a flowchart outlining an exemplary embodiment of the method for signal processing.

FIG. 12 is a flowchart outlining in greater detail one exemplary embodiment of the method for analyzing the received sensor signals according to this invention. Beginning in step S600, operation continues to step S605, where the transmitted sensor signal is received from the sensors. Then, in step S610, potential frequencies are identified in the received sensor signals. These frequencies correspond to the sensor that transmitted the received sensor signals. Next, in step S615, a candidate sensor is selected that corresponds to an identified frequency. Operation then continues to step S620.

In step S620, a band pass filter is selected to isolate the potential frequency of the candidate sensor. Next, in step S625, the identified filtered frequency is tested against a table of frequency templates corresponding to the various sensors present in the system or device being tested. Then, in step S630, a determination is made whether a correlation was established between the recorded frequency signal and the template frequency. If a correlation is obtained, operation continues to step S635. Otherwise, operation jumps directly to step S645.

In step S635, the time at which the signal was generated is determined. Then, in step S640, the signal and its corresponding time are stored. Next, in step S645, a determination is made whether additional frequencies are still associated with the selected sensor. If no additional frequencies are associated with the sensor, operation continues to step S650. Otherwise, operation jumps back to step S620. In step S650, a determination is made whether another sensor for analysis should be selected. If no other sensor is to be selected, operation continues to step S655. Otherwise, operation jumps back to step S615.

In step S655, diagnostics are performed based on the identified signals and the associated times the identified signals were generated. Operation then continues to step S660, where the operation of the method returns to step S700.

While the exemplary embodiments described above involve using the wireless sensor systems and methods according to this invention with a printer system, it should be understood that the system and methods of this invention may be used with any other systems that could use the wireless sensor systems and methods according to this invention.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A printing device including a wireless sensor system usable to sense a position of paper having a predetermined bands printed thereon by a sensed system using predetermined timing data and to transmit a sound signal utilizing audio phrase data to transmit information when the bands are detected, the information being used for reconstructing the position and speed of paper, the wireless sensor system comprising:

a plurality of sensor subsystems provided on the printing device, each sensor subsystem including a sensor positioned along a paper path of the printing device and wirelessly transmitting information by transmitting the sound signal on at least one audio frequency that is unique to that sensor subsystem, the at least one audio frequency being generated based on a frequency defined in a frequency look-up table; and a signal processor subsystem that receives the wirelessly transmitted sound signal from the plurality of sensor subsystems and that determines, from time for transmission of the sound signal, a transmission time of the wirelessly transmitted information, wherein the signal processor subsystem determines which of the plurality of sensor subsystems transmitted the information based on the unique audio frequency used to transmit the information and the transmission time of the information, and the signal processor subsystem determines the position and speed of paper based on the timing data and the transmission time of the information for reconstructing the timing data.

2. The wireless sensor system of claim 1, wherein the signal processor subsystem determines a time that the information was transmitted and determines information about the second system based on information transmitted by at least some of the plurality of wireless sensor subsystems and the corresponding times of transmission.

3. The wireless sensor system of claim 1, wherein the signal processor subsystem determines information about the second system based on information transmitted by at least some of the plurality of wireless sensor subsystems and corresponding times of transmission of those information.

4. The wireless sensor system of claim 1, wherein:

each of at least some of the plurality of wireless sensor subsystems comprises an audio transmitter that outputs a sound signal; and the signal processor subsystem comprises at least one microphone that is capable of sensing the sound signals transmitted by the at least some of the wireless sensor subsystems.

5. The wireless sensor system of claim 4, wherein each of the at least some of the sensor subsystems outputs at least one audible-frequency sound signal.

6. The wireless sensor system of claim 5, wherein each of the at least some of the sensor subsystems outputs at least two audible-frequency sound signals having different frequencies.

7. The wireless sensor system of claim 1, wherein:

each of at least some of the plurality of wireless sensor subsystems comprises a transmitter that outputs a sound signal; and the signal processor subsystem comprises at least one receiver that is capable of sensing the sound signal transmitted by the at least some of the wireless sensor subsystems.

8. The wireless sensor system of claim 7, wherein each of the at least some of the sensor subsystems outputs at least one sound signal.

9. The wireless sensor system of claim 8, wherein each of the at least some of the sensor subsystems outputs at least two sound signals that can be distinguished in the signal processor subsystem by signal processing.

10. The wireless sensor system of claim 1, wherein each of at least some of the plurality of sensor subsystems comprises a multiple frequency signal generator that is capable of generating a plurality of signals at different frequencies.

11. The wireless sensor system of claim 10, wherein each of the at least some of the plurality of sensor subsystems further comprises:

a sensor that outputs a plurality of different sensor signals based on a condition of the sensed position of paper; and a signal processor that operates the multiple frequency generator to transmit a wireless signal at one of the plurality of frequencies based on the output sensor signal.

12. The wireless sensor system of claim 10, wherein the multiple frequency signal generator is capable of generating a plurality of sound signals at different frequencies.

13. A method for wirelessly sensing a position of paper having a predetermined bands printed thereon by a sensed system using predetermined timing data and transmitting a sound signal utilizing audio phrase data to transmit information when the bands are detected for reconstructing the position and speed of paper, in a printing device, comprising:

sensing the position of paper using a plurality of wireless sensor devices, each wireless sensor device positioned along a paper path of the printing device and capable of sensing a condition of the position and speed of paper;

outputting a wireless sensor signal by transmitting the sound signal based on the sensed condition from each wireless sensor device at least one audio frequency that is unique to that wireless sensor device, the at least one audio frequency being generated based on a frequency defined in a frequency look-up table;

receiving a plurality of the wireless sound signals from at least some of the plurality of wireless sensor devices;

determining a unique audio frequency of each of the received wireless sensor signals;

determining a transmission time of the received wireless sound signal from time for transmission of the sound signal;

determining which of the plurality of wireless sensor devices output the received wireless sensor signals based on the determined unique audio frequencies for the received wireless sound signal and the transmission time of the received wireless sound signal; and determining the position and speed of paper based on the timing data and the transmission time of the received wireless sound signal for reconstructing the timing data.

14. The method of claim 13, further comprising determining, for each received wireless sensor signal, a time when that wireless sensor signal was output by the determined wireless sensor device corresponding to that received wireless sensor signal.

15. The wireless sensor system of claim 1, wherein the signal processor system receives the wirelessly transmitted information from the plurality of sensor subsystems that overlaps with another received wireless transmitted information, each wirelessly transmitted information having a different unique audio frequency.

16. The method of claim 13, wherein the wirelessly transmitted information that is received from the at least some of the plurality of wireless sensor devices overlap with another received wireless transmitted information, each wirelessly transmitted information having a different unique audio frequency.

17. The method of claim 13, wherein the audio phrase data is a sound signal.

18. The method of claim 17, wherein the sound signal is only a few cycles of the unique audio frequency.

19. The wireless sensor system of claim 7, wherein the sound signal is only a few cycles of the unique audio frequency.

20. The wireless sensor system of claim 4, wherein at least one of the plurality of the wireless sensor subsystems comprises an: optical sensor that detects at least one of black-to-white and white-to-black transmission of the bands on the paper passing below the optical sensor.

* * * * *